United States Patent [19]

Grasshoff et al.

[11] Patent Number: 4,794,067

[45] Date of Patent: Dec. 27, 1988

[54] COPOLYMERIC MORDANTS AND PHOTOGRAPHIC PRODUCTS AND PROCESSES CONTAINING SAME

[75] Inventors: J. Michael Grasshoff, Hudson; Myron S. Simon, West Newton, both of Mass.

[73] Assignee: Polaroid Corporation, Patent Dept., Cambridge, Mass.

[21] Appl. No.: 123,884

[22] Filed: Nov. 23, 1987

[51] Int. Cl.[4] ..... G03C 5/54

[52] U.S. Cl. ..... 430/213; 430/941; 526/310

[58] Field of Search ..... 430/213, 941, 518; 526/310

[56] References Cited

U.S. PATENT DOCUMENTS

| | | | |
|---|---|---|---|
| 3,148,061 | 9/1964 | Haas | 430/213 |
| 3,758,445 | 9/1973 | Cohen et al. | 260/78 |
| 3,770,439 | 11/1973 | Taylor | 430/213 |
| 3,898,088 | 8/1975 | Cohen et al. | 430/213 |
| 4,080,346 | 3/1978 | Bedell | 260/17 A |
| 4,308,335 | 12/1981 | Yamamoto et al. | 430/213 |
| 4,322,489 | 3/1982 | Land et al. | 430/213 |
| 4,563,411 | 1/1986 | Bronstein-Bonte | 430/213 |
| 4,680,247 | 7/1987 | Murphy | 430/215 |

*Primary Examiner*—Richard L. Schilling

*Attorney, Agent, or Firm*—Louis G. Xiarhos

[57] ABSTRACT

Copolymeric mordants coatable from water into copolymeric mordant layers for photographic products and processes are disclosed. The copolymeric mordants comprise polymerized repeating units from first and second polymerizable vinylbenzyl quaternary ammonium compounds (the first polymerizable compound, if homopolymerized, providing a water-soluble homopolymer and the second polymerizable compound being a micelle-forming compound which, if homopolymerized, forms a water-insoluble homopolymer). The copolymeric mordants are coatable to image-receiving layers for the mordanting of dyes in photographic products and processes.

24 Claims, 2 Drawing Sheets

COPOLYMERIC MORDANTS AND PHOTOGRAPHIC PRODUCTS AND PROCESSES CONTAINING SAME

BACKGROUND OF THE INVENTION

This invention relates to copolymeric materials having dye mordanting capability. More particularly, it relates to copolymeric mordant materials especially suited to application in photographic diffusion transfer products and processes.

Diffusion transfer photographic products and processes have been described in numerous patents, including, for example, U.S. Pat. Nos. 2,983,606; 3,345,163; 3,362,819; 3,594,164; and 3,594,165. In general, diffusion transfer photographic products and processes involve film units having a photosensitive system including at least one silver halide layer usually integrated with an image-providing material, e.g., an image dye-providing material. After photoexposure, the photosensitive system is developed, generally uniformly distributing an aqueous alkaline processing composition over the photoexposed element, to establish an imagewise distribution of a diffusible image-providing material. The image-providing material is selectively transferred, at least in part, by diffusion to an image-receiving layer or element positioned in a superposed relationship with the developed photosensitive element and capable of mordanting or otherwise fixing the image-providing material. The image-receiving layer retains the transferred image for viewing and in some diffusion transfer products, the image is viewed in the layer after separation from the photosensitive element, while in other products, such separation is not required.

Various polymeric materials have been utilized as mordants in photographic products and processes including those of the diffusion transfer type. Thus, polymeric mordants suited to application in diffusion transfer products and processes for the formation of photographic images in dye are described, for example, in U.S. Pat. Nos. 3,148,061 (issued Sept. 8, 1964 to H. C. Haas); 3,758,445 (issued Sept. 11, 1973 to H. L. Cohen, et al.); 3,770,439 (issued Nov. 6, 1973 to L. D. Taylor); 3,898,088 (issued Aug. 5, 1975 to H. L. Cohen, et al.); 4,080,346 (issued Mar. 31, 1978 to S. F. Bedell); 4,308,335 (issued Dec. 29, 1981 to T. Yamamoto, et al.); 4,322,489 (issued Mar. 30, 1982 to E. H. Land, et al.) and 4,563,411 (issued Jan 7, 1986 to I. Y. Bronstein-Bonte).

The utilization of a particular mordanting material in a photographic product or process will oftentimes depend upon the particular requirements of a photographic product or process and deficiencies or disadvantages associated with the use of a particular mordanting material may be observed. Deficiencies in mordanting capacity, particularly, with respect to one or more dye material desirably utilized, may be noted. Desirable mordanting benefits may be realized in some instances by utilizing copolymeric mordant materials obtained, for example, by the polymerization of a polymerizable mordanting compound along with one or more copolymerizable compounds. Examples of copolymeric mordants are disclosed, for example, in the aforementioned U.S. Pat. Nos. 3,770,439; 3,898,088; 4,308,335; 4,322,489 and 4,563,411. The suitability of a copolymeric mordant will be dictated largely by the particular monomeric compounds used in the preparation thereof and the particular nature of a photographic system. In addition, difficulties in the synthesis of such copolymeric mordanting materials, and in the production of efficient mordanting materials that can be readily coated into a suitable image-receiving layer, may present formidable limitations upon practical utilization.

It is an object of the present invention to provide polymeric mordant exhibiting efficient dye mordanting capability.

It is another object of the present invention to provide polymeric mordants exhibiting such mordanting capability and adapted to utilization in photographic products and processes.

Still another object of the present invention is the provision of polymeric mordants capable of ready synthesis and efficient utilization in the preparation of coated image-receiving layers containing such polymeric mordants.

Other objects of the present invention will become apparent from the description appearing hereinafter.

SUMMARY OF THE INVENTION

These and other objects can be achieved by the present invention which provides copolymeric mordant materials containing repeating units according to the formula, (I)

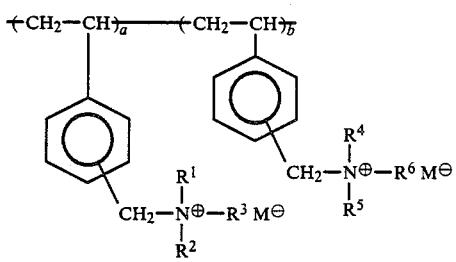

Formula (I)

wherein each of $R^1$, $R^2$ and $R^3$ is independently alkyl of from 1 to 4 carbon atoms; each of $R^4$, $R^5$ and $R^6$ is independently alkyl of from 1 to 18 carbon atoms and the total number of carbon atoms in $R^4$, $R^5$ and $R^6$ is from 13 to 20; each $M^{\ominus}$ is an anion; and each of a and b is the molar proportion of each of the respective repeating units.

It has been found that copolymeric mordants, especially suited to use as mordants in photographic products and processes, can be conveniently obtained by copolymerizing first and second vinylbenzyl quaternary ammonium compounds having the following formulas, (Ia) and (Ib), respectively,

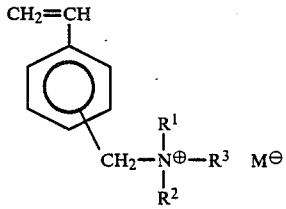

Formula (Ia)

and

-continued

Formula (Ib)

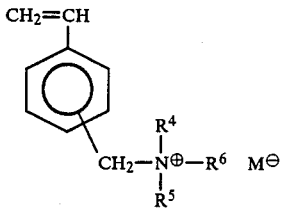

wherein each of $R^1$, $R^2$, $R^3$, $R^4$, $R^5$, $R^6$ and $M\ominus$ have the hereinbefore described meanings. Inspection of Formula (I) representing the copolymers of the invention and the formulas for the respective monomeric vinylbenzyl quaternary ammonium compounds used in the production thereof, i.e., Formulas (Ia) and (Ib), will show that the copolymers of the invention comprise repeating units (in a molar amount "a") derived from a first polymerizable vinylbenzyl quaternary ammonium compound of Formula (Ia), and repeating units (in a molar amount "b") derived from a second polymerizable vinylbenzyl quaternary ammonium compound of Formula (Ib).

It has found that the copolymerization of first and second copolymerizable vinylbenzyl quaternary ammonium compounds of Formulas (Ia) and (Ib), respectively, each of the copolymerized compounds tending to promote different solubility characteristics in water, enables the production of mordant materials which exhibit good mordanting properties and which can be readily and reproducibly polymerized and coated into dye mordanting layers for photographic products.

In a product or article aspect of the present invention, there is provided an image-receiving element comprising a support carrying an image-receiving layer comprising a copolymeric mordant as aforedescribed. In another of its product or article aspects, the invention provides a diffusion transfer film unit which comprises a photosensitive system including at least one photosensitive silver halide emulsion layer having associated therewith a diffusion transfer process image dye-providing material and an image-receiving layer adapted to receive an image dye-providing material after photoexposure and processing, the image-receiving layer comprising a copolymeric mordant as aforedescribed.

In a process aspect of the present invention, there is provided a process for forming a diffusion transfer image which comprises the steps of exposing a photosensitive silver halide emulsion layer having associated therewith a diffusion transfer image dye-providing material; contacting the exposed photosensitive system with an aqueous alkaline processing composition, thereby effecting development of the silver halide emulsion (or emulsions) and the formation of an imagewise distribution of diffusion image dye-providing material; and transferring, by imbibition, at least a portion of the imagewise distribution of diffusible image dye-providing material to a superposed image-receiving layer comprising a copolymeric mordant as aforedescribed.

For a fuller understanding of the nature and objects of the present invention, reference should be had to the following detailed description taken in connection with the accompanying drawings.

DETAILED DESCRIPTION OF THE INVENTION

Figure 1:
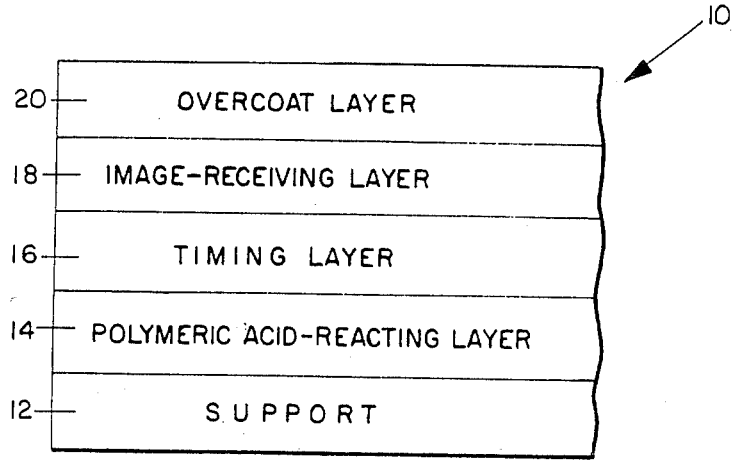
FIG. 1 is a diagrammatic cross-sectional view of an image-receiving element of the invention comprising a support material; a polymeric acid-reacting layer, a timing layer, an image-receiving layer of the invention and an overcoat layer.

As mentioned previously, the copolymeric mordants of the invention include repeating units from first and second copolymerizable vinylbenzyl quaternary ammonium compounds having, respectively, a different complement of alkyl substituent groups. Thus, in the vinylbenzyl quaternary ammonium compounds of Formula (Ia), i.e.,

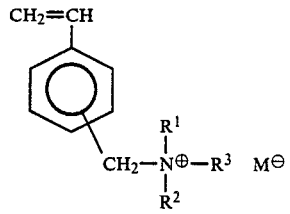

each of $R^1$, $R^2$ and $R^3$ is an alkyl group of from 1 to 4 carbon atoms. Suitable alkyl groups include, methyl, ethyl, propyl or butyl. The nature of the $R^1$, $R^2$ and $R^3$ groups, in combination, is such that the polymerizable compound, if homopolymerized, would provide a water-soluble homopolymer. Suitable combinations of $R^1$, $R^2$ and $R^3$ groups are illustrated in the following table:

| Monomer | $R^1$ | $R^2$ | $R^3$ |
|---|---|---|---|
| Ia-1 | $CH_3$ | $CH_3$ | $CH_3$ |
| Ia-2 | $C_2H_5$ | $C_2H_5$ | $C_2H_5$ |
| Ia-3 | $C_2H_5$ | $CH_3$ | $CH_3$ |
| Ia-4 | n-$C_4H_9$ | n-$C_4H_9$ | n-$C_4H_9$ |
| Ia-5 | n-$C_3H_7$ | n-$C_3H_7$ | n-$C_3H_7$ |
| Ia-6 | n-$C_4H_9$ | $CH_3$ | $CH_3$ |
| Ia-7 | n-$C_4H_9$ | $CH_2H_5$ | $CH_3$ |

In general, the individual nature of the $R_1$, $R_2$ and $R_3$ alkyl groups and the total number of carbon atoms in the such groups of the Formula (Ia) polymerizable monomer will be such that the monomer exhibits water solubility. The monomers, vinylbenzyl trimethyl ammonium chloride and vinylbenzyl triethyl ammonium chloride, are examples of such water-soluble monomers. Preferably, the total number of carbon atoms in $R^1$, $R^2$ and $R^3$ will be in the range of 3 to 9, especially 3 or 6.

In the polymerizable monomers of Formula (Ia), $M\ominus$ represents an anion, which can be halogen (e.g., chloride or bromide), alkylsulfate (e.g., methylsulfate), alkylsulfonate (e.g., methylsulfonate) or arylsulfonate (e.g., benzenesulfonate or toluenesulfonate). Other anions can be used if desired. A preferred anion is the chloride anion.

Preferred polymerizable monomers of Formula (Ia) include vinylbenzyl trimethyl ammonium chloride, vinylbenzyl triethyl ammonium chloride and vinylbenzyl tri-n-propyl ammonium chloride. Such monomers are readily available, and in combination with monomers of the type represented by Formula (Ib), provide copolymers having good mordanting properties.

In the vinylbenzyl quaternary compounds of Formula (Ia), the illustrated quaternary nitrogen-containing moiety of the formula

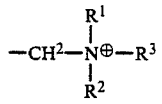

is shown as varying in position on the illustrated phenyl group. While the positioning of such moiety is not limited to a particular position, the moiety will preferably be positioned at the para- or meta- position with respect the vinyl group. Typically, a vinylbenzyl quaternary compound of Formula (Ia) will be employed as a mixture of positional isomers. An example of a preferred mixture is a mixture of para and meta isomers of vinylbenzyl trimethyl ammonium chloride.

In preparing copolymers of the Formula (Ia) and Formula (Ib) compounds, there can be employed as the Formula (Ia) component of polymerizable vinylbenzyl quaternary ammonium compound, a single compound conforming to the requirements of Formula (Ia), or a combination of two or more such compounds which differ in the make-up of the $R^1$, $R^2$ and $R^3$ groups. For example, the Formula (Ia) component can comprise vinylbenzyl trimethyl ammonium chloride in combination with vinylbenzyl triethyl ammonium chloride. In general, it will be preferred from the standpoint of polymerization control to employ a single compound of Formula (Ia) or a mixture of positional isomers, i.e., a mixture wherein the isomeric forms (e.g., para and meta isomers) contain the same $R^1$, $R^2$ and $R^3$ groups.

The Formula (Ib) vinylbenzyl ammonium compound used in the production of the copolymers of the invention is a water-soluble, micelle-forming compound wherein each of the $R^4$, $R^5$ and $R^6$ groups is an alkyl group of from 1 to 18 carbon atoms and wherein the total number of carbon atoms in the $R^4$, $R^5$ and $R^6$ groups is from 13 to 20. The $R^4$, $R^5$, $R^6$ groups are chosen so as to provide a copolymerizable vinylbenzyl ammonium compound which is micelle-forming in water. Such a compound (which if homopolymerized, typically forms a water-insoluble homopolymer that can only be coated into a mordanting layer from an organic solvent material) can be copolymerized with a Formula (Ia) polymerizable compound to provide a copolymeric mordant material that can be coated from water without the required use of an organic solvent material.

As can be seen from the nature of the $R^4$, $R^5$ and $R^6$ alkyl groups, which contain a total of at least 13 carbon atoms, one of $R^4$, $R^5$ and $R^6$ can have at least 11 carbon atoms, e.g., from 11 to 18 carbon atoms. In such case, the remaining R groups should be chosen such that the total number of carbon atoms in $R^4$, $R^5$ and $R^6$ is in the range of from 13 to 20. If desired, each of $R^4$, $R^5$ and $R^6$ can be the same and can have, for example, 6 carbon atoms. Suitable examples of Formula (Ib) monomer compounds include those vinylbenzyl quaternary ammonium compounds having the follwwing $R^4$, $R^5$ and $R^6$ groups.

| Monomer | $R^4$ | $R^5$ | $R^6$ |
|---|---|---|---|
| I(b)-1 | n-$C_{11}H_{23}$ | $CH_3$ | $CH_3$ |
| I(b)-2 | n-$C_{12}H_{25}$ | $CH_3$ | $CH_3$ |
| I(b)-3 | n-$C_{14}H_{29}$ | $CH_3$ | $CH_3$ |
| I(b)-4 | n-$C_{16}H_{33}$ | $C_2H_5$ | $C_2H_5$ |
| I(b)-5 | n-$C_{18}H_{37}$ | $CH_3$ | $CH_3$ |
| I(b)-6 | n-$C_6H_{13}$ | n-$C_6H_{13}$ | n-$C_6H_{13}$ |

As in the case of the Formula (Ia) monomers, the vinylbenzyl quaternary ammonium compound of Formula (Ib) can be a single compound or a mixture of compounds having dissimilar $R^4$, $R^5$ and $R^6$ groups. Positional isomer mixtures can also be employed, para/-meta mixtures being particularly preferred.

The copolymeric mordants of the invention can be prepared by introducing the Formula (Ia) and (Ib) vinylbenzyl quaternary ammonium compounds into an aqueous polymerization medium and effecting the desired copolymerization with the aid of a free-radical polymerization initiator or redox initiator. Suitable free-radical initiators include the water-soluble or alcohol soluble azo-type initiators such as 4,4'-azobis-4(cyanovaleric acid), azobisisobutyronitrile, diazoaminobenzene and 2-2'-azobis(2-carbamidinopropaee) hydrochloride. Suitable redox-type polymerization initiators include a combination of a reducing agent such as sodium bisulfite, ascorbic acid or a ferrous salt and an oxidizing agent such as benzoyl peroxide, ammonium persulfate, hydrogen peroxide, diacetyl peroxide, t-butyl hydroperoxide or an alkali metal persulfate. The amount of catalyst employed can be varied to suit particular needs. In general, satisfactory polymerization reactions can be conducted over a temperature range of from about 25° C. to about 100° C. utilizing less than 5% by weight of the initiator, based upon the weight of the copolymerizable monomers.

If desired, a surfactant or emulsifying agent can be used in the copolymerization of the Formula (Ia) and (Ib) monomers. A suitable emulsifier is a cationic emulsifier such as hexadecyltrimethyl ammonium bromide. Other emulsifiers can be employed. The provision of coatable mordant materials without the use of an emulsifier can, however, be accomplished.

The ratio of repeating units in the copolymeric mordants hereof, represented by integers a and b in the copolymers of Formula (I), can vary. The molar ratio of repeating units from a Formula (Ia) vinylbenzyl quaternary ammonium compound to repeating units from a formula (Ib) vinylbenzyl quaternary ammonium compound, i.e., the ratio of a:b, will normally vary within the range of from 2:1 to 50:1. In general, the ratio of such repeating units should be such as to provide in the copolymers a proportion of Formula (Ib) units tending to introduce hydrophobicity an insolubility into the copolymer, without introduction of unacceptable hydrophobicity that tends to reduce mordanting capacity and obtainable dye densities. For example, monomer ratios lower than 2:1 tend to produce copolymers having excessive hydrophobicity and reduced mordanting capacity. Ratios greater than about 50:1 tend to provide copolymers which contain insufficient hydrophobicity and a high level of water solubility, owing to a too-low level of Formula (Ib) units. It will be appreciated that the relative proportions of Formula (Ia) and Formula (Ib) units desirably employed will depend upon the particular nature of each of the Formula (Ia) and (Ib)

compounds chosen, and in particular, upon the nature of the hydrophilic, hydrophobic, solubilizing and insolubilizing influences of such monomers on the properties desired in the copolymeric mordant.

Preferably, the molar ratio of a:b will be in the range of from 3:1 to 25:1. Good results can be obtained, for example, from mixtures of vinylbenzyl triethyl ammonium chloride and vinylbenzyl trihexyl ammonium chloride, at ratios (of the former to the latter) of from 5:1 to 10:1. Similarly, good results are obtained from mixtures of vinylbenzyl trimethyl ammonium chloride and vinylbenzyl dodecyldimethyl ammonium chloride, >at ratios of from 10:1 to 20:1.

The properties of the copolymeric mordants of the invention can vary depending upon the particular nature of the Formula (Ia) and (Ib) vinylbenzyl quaternary ammonium monomers employed in the copolymerization, and especially on the respective ratios thereof. The copolymeric mordant can be a viscous fluid or in the nature of a gel. Certain of the polymers exhibit viscoelastic properties and depending upon the particular monomers and proportions may exhibit a colloidal character in the nature of a hydrosol. Differences in alkali solubility or swellability, alkali permeability, hydrophilic-hydrophobic balance, coatability of the copolymeric mordant or respectivity of the copolymeric mordant to one or more dyes may be observed. Variations in molar ratios can be made in the interests of maximizing mordanting properties or adjusting mordanting properties to suit particular desires or requirements or to adapt the copolymeric mordant to efficient utilization in a particular photographic product or system.

The copolymeric mordants of the invention process certain beneficial properties. In general, the use of the copolymer mordants allows for the attainment of higher maximum dye densities than is obtained by a homopolymer of either the Formula (Ia) or (Ib) monomer. In addition, the copolymers can be coated from an aqueous medium without the requirement of an organic solvent and associated solvent drying and recovery operations. If desired, however, minor amounts of organic materials, such as alcohols, can be employed as a viscosity-controlling agent or as a coating aid. Inasmuch as the Formula (Ia) and (Ib) monomers are each vinylbenzyl quaternary compounds and have structural similarity, the copolymerization of the monomers can be accomplished in a controlled and reproducible fashion without the production of large segments or homopolymeric fractions produced by the polymerization of an ethylenic compound having a substantially different structure. Inasmuch as each of the Formula (Ia) and (Ib) compounds contains a quaternary ammonium mordanting site, the desired physical properties of the copolymeric mordant are obtained while maintaining a large number of mordanting sites in the polymer. This represents an advantage as compared with mordant copolymers containing a substantial proportion of polymerized repeating units obtained from a nonmordanting compound.

The copolymeric mordant materials of the present invention can be utilized for the provision of an image-receiving layer for photographic images in dye, and in particular, for the provision of multicolor dye images. The copolymeric mordant material of the invention can alone comprise the image-receiving layer or can be employed in admixture with other polymeric materials to comprise an image-receiving layer Particularly preferred is an image-receiving layer comprising a mixture or blend of a copolymeric mordant material of the invention, as hereinbefore described, with other known polymeric image-receiving layer materials, particularly hydrophilic polymeric materials such as gelatin, polyvinyl alcohol, polyvinylpyrrolidones, and mixtures of these. The materials utilized in admixture with the copolymeric mordant material hereof, and relative amounts of each, can depend, for example, on the nature and amount of dye desirably mordanted and upon the permeability of the image receiving layer to an aqueous alkaline processing composition. Particularly preferred image-receiving layers comprise a mixture of the copolymeric mordant hereof and polyvinyl alcohol where the ratio by weight of polyvinyl alcohol to the copolymeric mordant hereof is about 0.3:1 to about 3:1. For example, good results are realized using a 1/1 weight ratio of copolymeric mordant and polyvinyl alcohol.

Image-receiving layers comprising the copolymeric mordants of this ivvention can be utilized, for example, in image-receiving elements designed to receive and mordant image dye-providing materials. Such image-receiving elements will generally comprise a suitable support carrying an image-receiving layer comprising a copolymeric mordant of this invention and may also include one or more polymeric acid-reacting layers such as those described, for example, in U.S. Pat. No. 3,362,819. These polymeric acids can be polymers which contain acid groups, e.g., carboxylic acid and sulfonic acid groups, which are capable of forming salts with alkali metals or with organic bases; or potentially acid-yielding groups such as anhydrides or lactones. The polymeric acid-reacting layer functions to reduce the environmental pH of a diffusion transfer system in which the image-receiving layer is utilized and, thereby, provides the advantages and benefits thereof known in the art.

A spacer layer may be disposed between the polymeric acid layer and the image-receiving layer in order to control the pH reduction so that it is not premature, e.g., to "time" control the pH reduction. Suitable spacer of "timing" layers for this purpose are described, for example, in U.S. Pat. Nos. 3,362,819; 3,419,398; 3,431,893; 3,433,633; 3,455,686; 3,575,701 and 3,756,815.

Referring to FIG. 1, there is shown an image-receiving element of the invention 10 comprising support material 12 carrying a layer of acid-reacting polymer 14, a timing layer 16, and image-receiving layer 18 comprising a copolymeric mordant of the invention and optional overcoat layer 20. Support material 12 can comprise any of a variety of materials capable of carrying image-receiving layer 18 and other layers as shown in FIG. 1. Paper, vinyl chloride polymers, polyamides such as nylon, polyesters such as polyethylene glycol terephthalate or cellulosic derivatives such as cellulose acetate or cellulose acetate-butyrate can be suitably employed. It will be appreciated that depending upon the particular application intended for image-receiving element 10, the nature of support material 12 as a transparent, opaque or translucent material will be a matter of choice.

According to one embodiment of the present invention, image-receiving element 10 can comprise support material 12 on which is present image-receiving layer 18. Polymeric acid-reacting layer 14 and timing layer 16, each shown in FIG. 1, need not be present in image-receiving element 10, and where such an image-receiving element is utilized in a photographic diffusion transfer product or process, polymeric acid-reacting and timing layers 14 and 16, respectively, can be otherwise suitably positioned in such product or process as will be apparent from the film unit of FIG. 3, described in greater detail hereinafter. According to one embodiment, image-receiving element 10 will include polymeric acid-reacting and timing layers, shown, respectively, in FIG. 1 as layers 14 and 16. The nature and function of such layers in diffusion transfer products and processes is known and described in greater detail hereinafter.

As indicated previously, support 12 or image-receiving element or article 10 can be transparent, opaque or translucent depending upon a particular application of the element or article. Thus, where image-receiving element 10 is desirably utilized in the manufacture of photographic diffusion transfer film units such as shown generally in FIGS. 2 and 3 hereof, where the desired image will be viewed through a support, support 12 will be of transparent material. A preferred material for this purpose is a polyethylene glycol terephthalate sheet-like support material. Alternatively, where image-receiving element 10 is utilized in the manufacture of a photographic film unit such as is generally shown in FIG. 4, where the desired image will be viewed as a reflection print against a light-reflecting layer, support material 12 will preferably be of opaque material.

In FIG. 1 is shown overcoat layer 20 which comprises an optional layer of image-receiving element 10. Image-receiving layer 18 can, thus, comprise the outermost layer of image-receiving element 10. In some instances, it may be desirable to provide image-receiving layer 18 with a washing treatment, as by washing the layer with ammonia or a solution of ammonium hydroxide in a concentration, preferably of from about 2% to about 8% by weight. Such ammonia washing treatment effectively neutralizes residual acrolein/formaldehyde condensate where such material is utilized for the hardening of the image-receiving layer and for the provision of reduced water sensitivity. According to one embodiment of the invention, overcoat layer 20 can comprise a polymeric material such as polyvinyl alcohol.

Overcoat layer 20 can also be utilized as a means of facilitating separation of image-receiving element 10 from a photosensitive element. Thus, where the image-receiving element is utilized in a photographic film unit which is processed by distribution of an aqueous alkaline processing composition between the image-receiving element and a photoexposed photosensitive element and is adapted, after formation of a dye image, to separation from the developed photosensitive element and the processing composition, overcoat layer 20 can effectively function as a "strip coat".

A suitable "strip coat" can be prepared from a hydrophilic colloid material such as gum arabic or the like. For example, overcoat 20 can comprise a solution of hydrophilic colloid and ammonia and can be coated from an aqueous coating solution prepared by diluting concentrated ammoniumhydroxide (about 28.7% $NH_3$) with water to the desired concentration, preferably from about 2% to about 8% by weight, and then adding to this solution an aqueous hydrophilic colloid solution having a total solids concentration in the range of about 1% to aout 5% by weight. The coating solution also preferably may include a small amount of surfactant, for example, less than 0.10% by weight of Triton X-100 (Rohm and Hass, Co., Phila., Pa.). A preferred solution comprises about 3 parts be weight of ammonium hydroxide and about 2 parts by weight of gum arabic.

Overcoat 20 can also be used as a means of decolorizing optical filter agent typically employed in a photographic processing composition. A polymeric layer 20 is provided over image-receiving layer 18 of an image-receiving element intended for use in a film unit of the integral negative-positive type, described in detail hereinafter. The decolorizing overcoat layer 20 serves to increase the apparent whiteness of the layer of processing composition providing the background against which the image is viewed. Suitable polymeric decolorizing materials for use as layer 20 are described in U.S. Pat. Nos. 4,298,674 (issued Nov. 3, 1911 to E. H. Land, et al.); 4,294,907 (issued Oct. 13, 1981 to I. Y. Bronstein-Bonte, et al., 4,367,277 (issued Jan. 4, 1983 to C. K. Chiklis, et al.; and in the copending patent application, U.S. Ser. No. 072,659, of G. S. La Pointe and R. J. Murphy, filed July 13, 1987.

The image-receiving layers of the present invention find applicability in a number of photographic diffusion transfer products and processes. According to one embodiment of the present invention, the image-receiving layers of the invention are utilized in photographic film units adapted to the provision of photographs comprising the developed silver halide emulsion(s) retained as part of a permanent laminate, with the desired image being viewed through a transparent support against a reflecting background. In such photographs, the image-carrying layer is not separated from the developed silver halide emulsion(s). Diffusion transfer photographic products providing an image viewable without separation against a reflecting background in such a laminate have been referred to in the art as "integral negative-positive film units".

Integral negative-positive film units of a first type are described, for example, in the abovenoted U.S. Pat. No. 3,415,644 and include appropriate photosensitive layer(s) and image-dye-providing materials carried on an opaque support, an image-receiving layer carried on a transparent support and means for distributing a processing composition between the elements of the film unit. Photoexposure is made through the transparent support carrying polymeric acid-reacting layer, a timing layer and the image-receiving layer of the invention. A processing composition containing a reflecting pigment is distributed between the image-receiving and photosensitive components. After distribution of the processing composition and before processing is complete, the film unit can be, and usually is, transported into light. Accordingly, in integral negative-positive film units of this type, the layer provided by distributing the reflecting pigment provides a reflecting background for viewing through the transparent support the image transferred to the image-receiving layer.

Integral negative-positive film units of a second type, as described, for example, in U.S. Pat. No. 3,594,165, include a transparent support, carrying the appropriate photosensitive layers and associated image dye-providing materials, a permeable opaque layer, a permeable and performed light-reflecting layer, and means for distributing a processing composition between the photosensitive layer and a transparent cover or spreader sheet carrying a polymeric acid-reacting layer and a timing layer. Integral negative-positive film units of this second type include an opaque processing composition which is distributed after photoexposure to provide a second opaque layer which can prevent additional exposure of the photosensitive element. In film units of this second type, exposure is made through the transparent cover or spreader sheet. The desired transfer image is viewed against the reflecting pigment-containing layer through the transparent support element.

The arrangement and order of the individual layers of the diffusion transfer film units described herein may vary in many ways as in known in the art, provided the film units comprise an image-receiving layer comprising a copolymeric mordant of the invention. For convenience, however, the more specific descriptions of the invention hereinafter set forth will be by use of dye developer diffusion transfer color processes and of diffusion transfer film units of the type generally contemplated in previously mentioned patents. Thus, details relating to integral negative-positive film units of the first type described hereinbefore can be found in such patents as U.S. Pat. Nos. 3,415,644 and 3,647,437 while details of the second type are found in U.S. Pat. No. 3,594,165. It will be readily apparent from such descriptions that other image-forming reagents may be used, e.g., color couplers, coupling dyes, or compounds which release a diffusible dye or dye intermediate as a result of coupling or oxidation.

Figure 2:
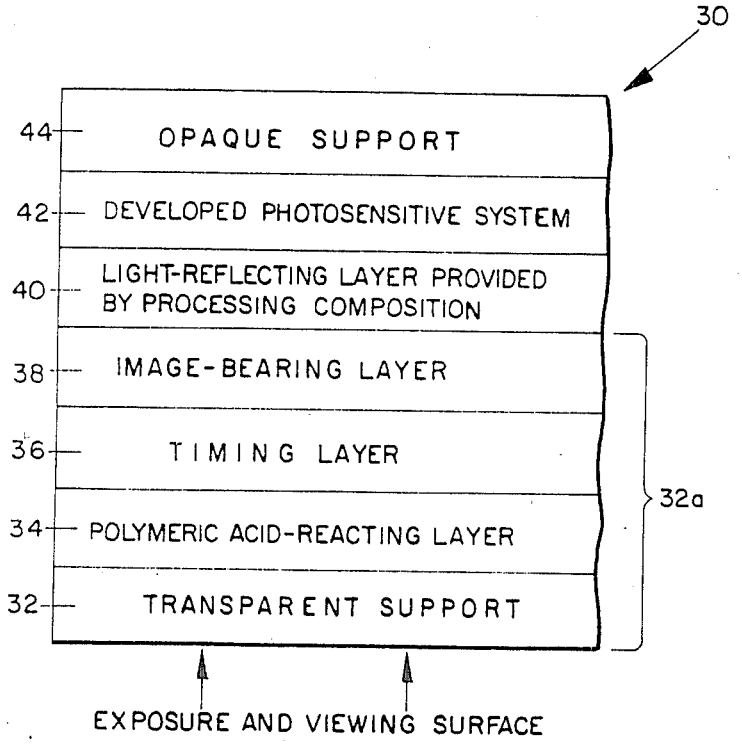
FIGS. 2 to 4 are simplified or schematic views of particular arrangments of film units embodying an image-receiving layer of the present invention and shown after exposure and processing.

Referring now to the drawings, FIG. 2 shows a film unit of the type described in referenced U.S. Pat. Nos. 3,415,644 and 3,657,437, following exposure and processing. The film unit 30 includes a polymeric acid-reacting layer 34, timing layer 36 and image-receiving layer 38 comprising a mordant copolymer of the invention. After photoexposure of photosensitive layer(s) 42 (through transparent support 32, polymeric acid-reacting layer 34, timing layer 36 and image-receiving layer 38) the processing composition retained in a rupturable container (not shown) is distributed between layers 38 and 42. Processing compositions used in such film units of the present invention are aqueous alkaline photographic processing compositions comprising a reflecting pigment, usually titanium dioxide, and a polymeric film-forming agent and will preferably contain an optical filter agent described in detail in U.S. Pat. Nos. 3,647,437 and 4,680,247.

Distribution of the processing composition over photoexposed portions of photosensitive system 42 provides a light-reflecting layer 40 between image-receiving layer 38 and photosensitive layer(s). This layer, at least during processing, provides sufficient opacity to protect photosensitive system 42 from further photoexposure through transparent support 32. As reflective layer 40 is installed, by application of the processing composition, development of photoexposed photosensitive layer(s) 42 is initiated to establish in manners well-known in the art an imagewise distribution of diffusible image-providing material which can comprise soluble silver complex or one or more dye or dye intermediate image-providing materials. The diffusible image-providing material is transferred through permeable, light-reflecting layer 40 where it is mordanted, precipitated or otherwise retained in or on image-receiving layer 38 of the invention. The resulting transfer image is viewed through transparent support 32 against light-reflecting layer 40.

The light-reflecting layer 40 provided by the embodiment of the invention shown in FIG. 2 is formed by solidification of the stratum of processing composition distributed after exposure. The processing composition will include the film-forming polymer which provides the polymeric binder matrix for the light-reflecting pigment of layer 40. Absorption of water from the applied layer of processing composition results in a solidified film comprising the polymeric binder matrix and the pigment material, thus providing the light-reflecting layer 40 which permits the viewing thereagainst of image 38 through transparent support 32. In addition, light-reflecting layer 38 serves to laminate together the developed photosensitive system 42 and the image-bearing layer 38 to provide the final photographic laminate.

Figure 3:
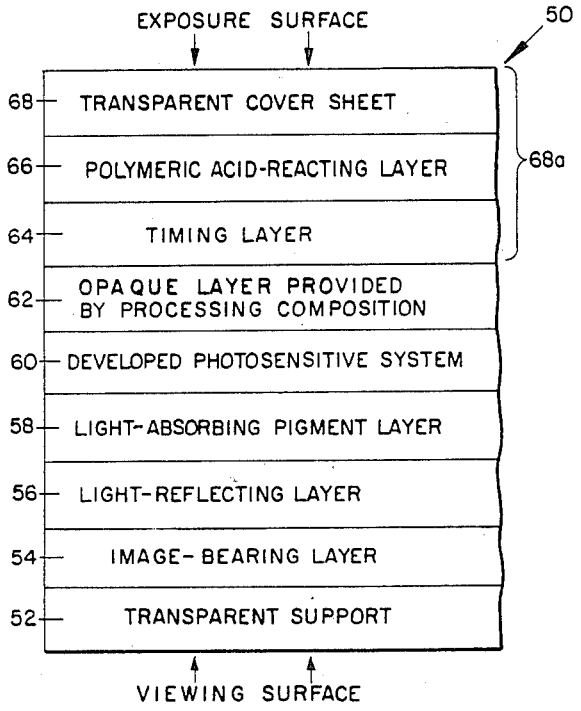
Figure 4:
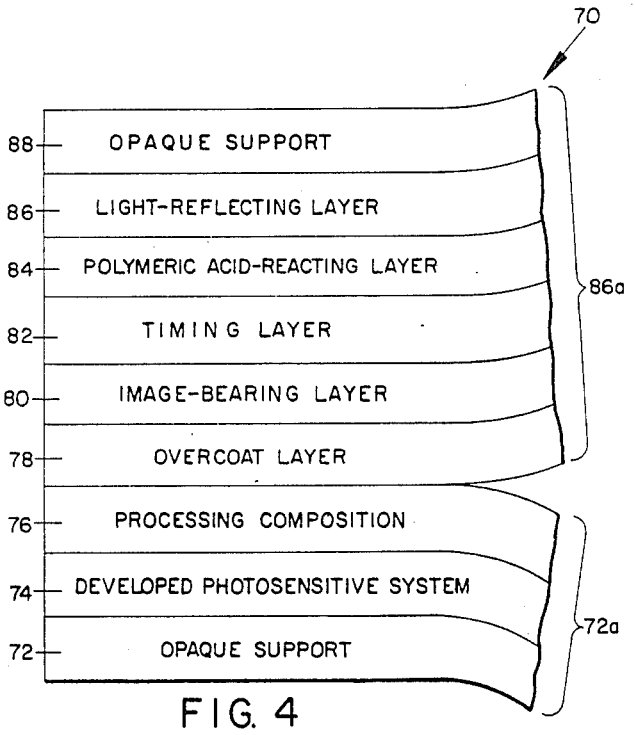

In each of article 10 and 30, respectively, of FIGS. 1 and 2, and in articles 50 and 70, respectively, of FIGS. 3 and 4, is shown a polymeric acid-reacting layer. In each instance, the pllymeric acid-reacting layer, e.g., layer 14 of image-receiving element 10, provides important functions in photographic processing. The processing compositions typically employed in diffusion transfer processes of the type contemplated herein will generally comprise an aqueous alkaline composition having a pH in excess of about 12, and frequently in the order to 14 or greater. The liquid processing composition element to effect development thereof. The elevated environmental pH conditions of the film unit upon spreading or distribution of the alkaline processing composition are conducive to the transfer of image dyes. The acid-reacting layer, for example, polymeric acid-reacting layer 14 of image-receiving element 10 or polymeric acid-reacting layer 34 of film unit 30 is, thus, employed to lower in predetermined manner the environmental pH of the film unit following substantial dye transfer in order to increase image stability and/or adjust the pH from a first pH at which the image dyes are diffusible to a second and lower pH at which such image-dyes are not diffusible. Simultaneously, the reduction of pH permits decolorization of opacification dyes utilized in the film unit to provide in-light development capability.

As disclosed in, for example, U.S. Pat. No. 3,362,819, the polymeric acid-reacting layer may comprise a non-diffusible acid-reacting reagent adapted to lower the pH from the first (high) pH of the processing composition in which the image dyes are diffusible to a second (lower) pH at which they are not. The acid-reacting reagents are preferably polymers which contain acid groups, e.g., carboxylic acid and sulfonic acid groups, which are capable of forming salts with alkali metals or with organic bases; or potentially acid-yielding groups such as anhydrides or lactones. Preferably, the acid groups contains free carboxyl groups. As examples of useful neutralizing layers, in addition to those disclosed in the aforementioned U.S. Pat. No. 3,362,819, mention may be made of those disclosed in the following U.S. Pat. Nos.: Bedell 3,765,885; Sahatjian, et al., 3,819,371; Haas, 3,833,367; Taylor 3,754,910 and Schlein, 3,756,815.

In each of the articles shown in FIGS. 1 to 4 is shown a timing layer which is included for the control of the pH-reducing properties of the polymeric acid-reacting layer. Thus, there is shown in FIG. 2 timing layer 36 positioned between polymeric acid-reacting layer 34 and image-receiving layer 38 of the invention. The spacer layer will be comprised of polyvinyl alcohol, gelatin or other polymer through which the alkali may diffuse to the polymeric acid-reacting layer. The presence of such a timing layer between the image-receiving layer 38 and the acid-reacting layer 34 effectively controls the initiation and the rate of capture of alkali by the acid-reacting layer. Suitable materials for the formation of timing layers and the advantages thereof in diffusion transfer systems are described with particularity in U.S. Pat. Nos. 3,362,819; 3,419,389; 3,421,893; 3,455,686; 3,577,237 and 3,575,701.

In the film unit shown in FIG. 2, polymeric acid-reacting layer 34 and the timing layer 36 are shown on transport support 32. If desired, layers 34 and 36 can be positioned between opaque support 44 and photosensitive layer(s) 42. Thus, polymeric acid-reacting layer 34 can be positioned on opaque support 44 and timing layer 36 can be positioned on the polymeric acid-reacting layer. In turn, the emulsion layer(s) comprising photosensitive system 42 can be positioned on the timing layer. In this case, image-receiving element **32*a* will comprise transparent support 32, and directly thereon, image-receiving layer 38**. The utilization of polymeric acid-reacting and timing layers in a photosensitive element as aforedescribed is described in U.S. Pat. Nos. 3,362,821 and 3,573,043.

In accordance with one embodiment of the invention, a photographic film unit can comprise a temporary laminate including the several layers of the photographic film unit confined between two dimensionally stable supports and having the bond between a predetermined pair of layers being weaker than the bond between other pairs of layers. Thus, with reference to FIG. 2, an image-receiving element **32*a*, comprising transparent support 32, polymeric acid-reacting layer 34, timing layer 36 and image-receiving layer 38 and corresponding generally to image-receiving element 10 of FIG. 1, can be arranged in article 30 such that image-receiving layer 38 is temporarily bonded to the silver halide emulsion layer 42 prior to exposure. The rupturable container or pod (not shown) can then be positioned such that, upon its rupture, the processing composition will delaminate the temporary bond and be distributed between the aforesaid layers 38 and 42. The distributed layer of processing composition upon drying forms light-reflecting layer 40** which serves to bond the layers together to form the desired permanent laminate. Procedures for forming such prelaminated film unit, i.e., film units in which the several elements are temporarily laminated together prior to exposure, are described, for example, in U.S. Pat. Nos. 3,652,281, issued to Albert J. Bachelder and Frederick J. Binda and 3,652,282 to Edwin H. Land both issued Mar. 28, 1972. A particularly useful and preferred prelamination utilizes a water-soluble polyethylene glycol as described and claimed in U.S. Pat. No. 3,793,023, issued Feb. 19, 1974 to Edwin H. Land.

If desired, the film unit shown in FIG. 2 may utilize a transparent support instead of the opaque support 44 shown therein. In accordance with this alternative embodiment, an opaque layer, e.g., pressure-sensitive, should be superposed over said transparent support to avoid further exposure through the back of the film unit during processing outside of the camera. In the embodiment illustrated in FIG. 2, photoexposure is effected through the image-receiving element. While this is a particularly useful and preferred embodiment, it will be understood that the image-receiving element may be initially positioned out of the exposure path and superposed upon the photosensitive element after photoexposure, in which event the processing and final image stages would be the same as in FIG. 2.

In FIG. 3 is shown, following exposure and processing, a second integral negative-positive type of diffusion transfer film unit of the invention utilizing an arrangement of elements generally described in U.S. Pat. No. 3,594,165 and British Pat. No. 1,330,524. Such arrangement provides an integral negative-positive reflection print and photoexposure and viewing are effected from opposite sides. Film unit 50 includes a processing composition initially retained in a rupturable container (not shown) arranged to distribute the processing composition between photosensitive system or layer 60 and a cover or spreader sheet **68*a* comprising a transparent sheet material 68, polymeric acid-reacting layer 66 and timing layer 64. Spreader sheet 68*a* facilitates uniform distribution of processing composition after photoexposure of photosensitive system or layer 60 which is effected throggh transparent sheet material 68**. Processing compositions used in such film units are aqueous, alkaline photographic processing compositions which include a light-absorbing opacifying agent, e.g., carbon black.

Distribution of the processing composition between photoexposed photosensitive system or layer 64 and spreader sheet **68*a* installs an opaque layer 62 which protects system or layer 60 from further photoexposure through transparent spreader sheet 68*a*. Like the film units of FIG. 3, as and after opaque layer 62 is installed, the processing composition initiates development of photoexposed photosensitive system or layer 60 to establish an imagewise distribution of diffusible image-providing material in manners well-known to the art. For example, the processing composition may contain developing agents sufficient to effect photographic development. Alternatively, developing agents may be present in one or more layers of the film unit so that they may be carried to system or layer 60 by the processing composition. The diffusible imagewise distribution is transferred to image-receiving layer 54 through permeable light-reflecting layer 56 which comprises a preformed layer including a light-reflecting pigment. Film units of the type shown in FIG. 3 may also comprise a preformed and permeable opaque layer 58 including a light-absorbing pigment, e.g., a dispersion of carbon black in a polymer permeable to the processing composition. Such layer, between photosensitive system or layer 60 and light-reflecting layer 56, permits in-light development of film unit 50, providing opacification for the protection of photoexposed photosensitive system or layer 60 against further exposure through transparent support 52 and layers 54 and 56. The transfer image is viewed through transparent support 52 against light-reflecting layer 56**.

The image-receiving layers of the present invention can be utilized in so-called "peel-apart" diffusion transfer film units designed to be separated after processing. Such a diffusion transfer film unit of the invention is shown in FIG. 4 as film unit 70. The film unit shown in FIG. 4 comprises a photosensitive element a comprising an opaque support 72 carrying a photosensitive layer or system 74. In film units of this type, the photosensitive layer or system 74 is photoexposed and a processing composition 76 is then distributed over the photoexposed layer or system. An image-receiving element **86*a*, corresponding generally to image-receiving element 10 of FIG. 1, is superposed on the photoexposed photosensitive element. As shown in FIG. 4, image-receiving element 86*a* comprises an opaque support material 88, and a light-reflecting layer 86; against which the desired transfer image is viewed and which typically will comprise a polymeric matrix containing a suitable white pigment material, e.g., titanium dioxide. A polymeric acid-reacting layer 84 is shown positioned on light-reflecting layer 86 on which is shown timing layer 82, the image-receiving layer 80 of the invention and, in turn, overcoat layer 78, each of which layers is comprised of materials described hereinbefore in connection with the articles and film units shown in FIGS. 1 to 3. Like the film units shown in FIGS. 2 and 3, the processing composition permeates photoexposed photosensitive layer or system 74 to provide an imagewise distribution of diffusible dye image-providing material which is transferred at least in part to image-receiving layer 78. Unlike the film units of FIGS. 2 and 3, however, the transferred dye image is viewed in image-bearing layer 80 against light-reflecting layer 66 after separation of image-receiving element 86***a* from photosensitive element 7*a*.

While support material 88 of image-receiving element 86*a* is shown as being of opaque material, it will be appreciated that a transparent support material can be employed and that the film unit can be processed in the dark or an opaque sheet (not shown), preferably pressure-sensitive, can be applied over such transparent support to permit in-light development. In accordance with a preferred embodiment of the invention, whereby a reflection print is provided upon separation of image-receiving element 86*a* from photosensitive element 72*a*, opaque support 88 and light-reflecting layer 86 will comprise, for example, a suitable paper support, coated, preferably on both sides, with a polymeric coating, e.g., polyethylene, pigmented with titanium dioxide. Such a support material can be suitably provided with polymeric acid-reacting layer 84, a timing layer 82, an image receiving layer 80 of the invention and optional overcoat layer 78, as shown in FIG. 4 with formation of image-receiving element 86*a*.

It will be appreciated that, where a transparency is desirably provided from film unit 70 of FIG. 4, support 88 can be transparent and light-reflecting layer 86 omitted. The desired image in image-bearing layer 80 can then, upon separation of image-receiving element 86*a* from photosensitive element 72*a*, be viewed as a positive transparency through transparent support material 88.

The film units illustrated in FIGS. 2 to 4 have, for convenience been shown as monochrome films. Multicolor images may be obtained by providing the requisite number of differentially exposable silver halide emulsion, and said silver halide emulsions are most commonly provided as individual layers coated in superposed relationship. Film units intended to provide multicolor images comprise two or more selectively sensitized silver halide layers each having associated therewith an appropriate image dye-providing material providing an image dye having spectral absorption characteristics substantially complementary to the light by which the associated silver halide is exposed. The most commonly employed negative components for forming multicolor images are of the "tripack" srructure and contain blue-, green-, and red-sensitive silver halide layers each having associated therewith in the same or in a contiguous layer a yellow, a magenta and a cyan image dye-providing material, respectively. Interlayers or spacer layers may, if desired, be provided between the respective silver halide layers and associated image dye-providing materials or between other layers. Integral multicolor photosensitive elements of this general type are disclosed in U.S. Pat. No. 3,345,163 issued Oct. 3, 1967, to Edwin H. Land and Howard G. Rogers, as well as in the previously noted U.S. patents, e.g., in FIG. 9 of the aforementioned U.S. Pat. No. 2,983,606.

The image dye-providing materials which may be employed in such processes generally may be characterized as either (1) initially soluble or diffusible in the processing composition, but are selectively rendered non-diffusible in an imagewise pattern as a function of development; or (2) initially insoluble or non-diffusible in the processnng composition, but which are selectively rendered diffusible or provide a diffusible product in an imagewise pattern as a function of development. These materials may be complete dyes or dye intermediates, e.g., color couplers. The requisite differential in mobility or solubility may, for example, be obtained by a chemical action such as a redox reaction or a coupling reaction.

As examples, of initially soluble or diffusible materials and their application in color diffusion transfer, mention may be made of those disclosed, for example, in U.S. Pat. Nos. 2,774,668; 2,968,554; 2,983,606; 2,087,817; 3,185,567; 3,230,082; 3,345,163 and 3,443,943. As examples of initially non-diffusible materials and their use in color transfer systems, mention may be made of the materials and systems disclosed in U.S. Pat. Nos. 3,185,567; 3,443,939; 3,443,940; 3,227,550 and 3,227,552. Both types of image dye-providing substances and film units useful therewith also are discussed in U.S. Pat. No. 3,647,437 to which reference maybe made.

The following examples are illustrative of the present invention and it will be understood that the invention is not limited thereto. All parts and percentages are by weight, except as otherwise indicated. In all instances, the vinylbenzyl trialkyl ammonium chloride monomers utilized in the polymerizations were mixtures predominantly of para and meta isomers, additionally containing a small content of ortho isomer. Accordingly, the molecular structures provided in the examples as representing repeating units from a vinylbenzyl trialkyl ammonium chloride show, for convenience, the positioning of the quaternary ammonium moiety without positional specificity to reflect the utilization of mixtures of positional isomers.

EXAMPLE 1

Into a two-liter, round-bottom, four-necked flask (equipped with a mechanical stirrer, thermometer, refluxing condenser and nitrogen inlet) were added 1200 mls. of deionized water. The reaction vessel containing the water was agitated (at 200 rpm) and purged with nitrogen at room temperature for 15 minutes. The reaction vessel was heated to 45° C. and there were added, consecutively, 15 g. of vinylbenzyl n-dodecy dimethyl ammonium chloride (DMQ; 0.041 mole); 175 g. of vinylbenzyl trimethyl ammonium chloride (TMQ; 0.82 mole); and 200 mls. of isopropanol. The resulting clear solution was further heated to 60° C., whereupon, the nitrogen inlet tube was raised above the liquid level and a solution of polymerization initiator was added (a solution of 0.75 g. of 2,2'-azobis(2-carbamidinopropane) hydrochloride having the structure

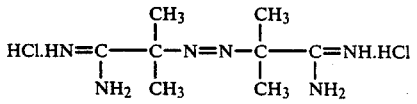

dissolve in 8 mls. of nitrogen-purged, deionized water). The reaction vessel contents were stirred for seven hours at 60° C. during which time (about 20 to 30 minutes after addition of the initiator) viscosity was observed to increase. After the reaction mixture had been heated for three hours, an additional content (0.25 g.) of initiator was added, as a powder. Upon completion of the heating period, the contents were allowed to cool to 50° C. and were discharged. The resulting copolymeric product was obtained as a viscous liquid having a solids content of 13.5% (wt/wt). Liquid chromatographic analysis for residual TMQ monomer showed a level of 0.01% (wt/wt) and no detectable amount of the DMQ monomer. The copolymer had the following composition:

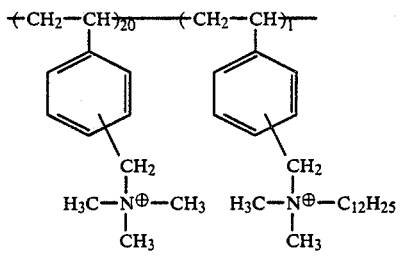

EXAMPLE 2

A 5:1 mole ratio copolymer of vinylbenzyl trimethyl ammonium chloride (TMQ) and vinylbenzyl n-dodecyl dimethyl ammonium chloride (DMQ) was prepared in the manner described in EXAMPLE 1, using 18.5 g. of TMQ, 6.5 g. of DMQ, 180 mls. of water and 20 mls. of isopropanol and an initiator solution containing 0.1 g. of the initiator in 2 mls. of water. Heating was performed for five hours at 60° C. and stirring was at 300 rpm. No additional increment of initiator was added. The copolymer was obtained as a very viscous fluid having a solids content of 13.5% (wt/wt).

EXAMPLE 3

A 10:1 mole ratio copolymer of TMQ and DMQ was prepared from 175 g. of TMQ, 30 g. of DMQ, 1250 mls. of water, 250 mls. of isopropanol and an initiator solution of 0.8 g. initiator in 8 mls. of water, using the procedure of EXAMPLE 2, except that, stirring was performed at 200 rpm at 60° C. for six hours. The reaction product was a viscous fluid having a solids content of 13.2% (wt/wt). The product, pourable at 55° C., solidified into a gel upon further cooling.

EXAMPLE 4

A 34:1 mole ratio copolymer of TMQ and DMQ was prepared from 25 g. of TMQ, 1.25 g. of DMQ, 200 mls. of water and an initiator solution of 0.1 g. initiator in 2 mls. water, using the procedure of EXAMPLE 2, except that no isopropanol was used in preparing the monomer solution; stirring was conducted at 200 rpm (to reduce foaming) for 5 hours at 61° C. Within one-half hour after addition of the initiator solution, the reaction contents were observed to become viscous and turbid and foaming was observed. The polymeric product was obtained at a solids content of 12.9% (wt/wt).

EXAMPLE 5

A 50:1 mole ratio copolymer of TMQ and DMQ was prepared from 26 g. of TMQ, 0.9 g. of DMQ, 200 mls. of water and an initiator solution of 0.1 g. initiator in 2 mls. water, using the procedure of EXAMPLE 4. The copolymeric product was obtained at a solids content of 11.0% (wt/wt).

EXAMPLE 6

The copolymeric products obtained from the conduct of EXAMPLES 1 to 5 were employed in the production of image-receiving elements. In each instance, the copolymeric product was diluted with water to a solids content of 4% (wt/wt) and was blended with an equal weight of a solution (4% wt/wt) of polyvinyl alcohol (PVA) in water. The resulting copolymer/-PVA blends were used for the coating of image-receiving layers onto a clear polyester support sheet (the polyester support sheet having a fluoropolymer antireflection coating on the side opposed from the image-receiving layer). A decolorizing overcoat layer was coated in each instance over the image-receiving layer. The image-receiving elements contained the following layers, in succession, on the polyester support sheet:

1. an image-receiving layer coated at a coverage of 200 mgs/ft$^2$ (2153 mgs/m$^2$) of TMQ/DMQ copolymer and 200 mgs/ft$^2$ (2153 mgs/m$^2$) of polyvinyl alcohol; and
2. an overcoat layer coated at a coverage of about 120 mgs/ft$^2$ (1292 mgs/m$^2$) comprising one part of polyvinyl hydrogen phthalate, ammonium salt and one part of a 1/1/0.35 mixture of Igepal CO-997 (nonylphenoxyethylene oxide ethanol), a 1/1/0.1/0.1 tetrapolymer of diacetone arylamide/-methacrylic acid/butyl acrylate/styrene, and polyvinylpyrrolidone.

The image-receiving elements are referred to hereinafter as image-receiving elements IRE-5/1 to IRE50/1 and contained the copolymer mordants of EXAMPLES 1 to 5 as follows:

| IMAGE-RECEIVING ELEMENT | TMQ/DMQ COPOLYMER OF: EXAMPLE | MOLE RATIO |
|---|---|---|
| IRE - 5/1 | 2 | 5/1 |
| IRE - 10/1 | 3 | 10/1 |
| IRE - 20/1 | 1 | 20/1 |
| IRE - 34/1 | 4 | 34/1 |
| IRE - 50/1 | 5 | 50/1 |

EXAMPLE 7

Photographic film units were prepared using each of the image-receiving elements described in EXAMPLE 6, the photosensitive element for each film unit being a multicolor photosensitive element prepared by coating the following layers; in succession onto an opaque subcoated polyethylene terephthalate film base of approximately 0.127 mm thickness:

1. a polymeric acid layer comprising about 24,400 mgs/m$^2$ of the half butyl ester of ethylene maleic anhydride, about 4310 mgs/m$^2$ of polyvinyl butyral and 89 mgs/m$^2$ of titanium dioxide;
2. a timing layer comprising a 40/40/18/1.85 tetrapolymer of butyl acrylate/diacetone acrylamide/carbomethoxymethyl acrylate/acrylic acid coated at a coverage of about 2800 mgs/m$^2$;
3. a cyan dye developer layer comprising about 551 mgs/m$^2$ of the cyan dye developer represented by the formula

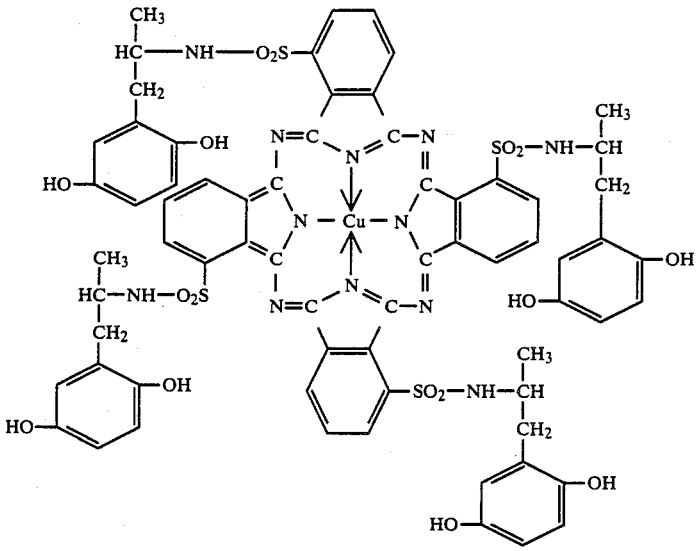

about 422 mgs/m$^2$ of gelatin; about 112 mgs/m$^2$ of 4'-methylphenyl hydroquinone (MPHQ); and about 65 mgs/m$^2$ of 1,3-bis[1-(4-hydroxyphenyl)-tetrazolyl-(5)-mercapto]-2-propanone oxime;

4. a layer comprising about 800 mgs/m$^2$ of titanium dioxide, about 375 mgs/m$^2$ of a 61/29/6/4/0.4 pentapolymer of butylacrylate/diacetone acrylamide/methylacrylic acid/styrene/acrylic acid, about 156 mgs/m$^2$ of gelatin and about 37.5 mgs/m$^2$ of polymethylmethacrylate;
5. a red-sensitive silver iodobromide layer comprising about 1268 mgs/m$^2$ of silver (1.5 microns) and about 855 mgs/m$^2$ of gelatin;
6. an interlayer comprising about 3249 mgs/m$^2$ of the pentapolymer described in layer 4, about 171 mgs/m$^2$ of polyacrylamide and about 134 mgs/m$^2$ of monomethylol dimethyl hydantoin;
7. a magenta dye developer layer comprising about 420 mgs/m$^2$ of magenta dye developer represented by the formula

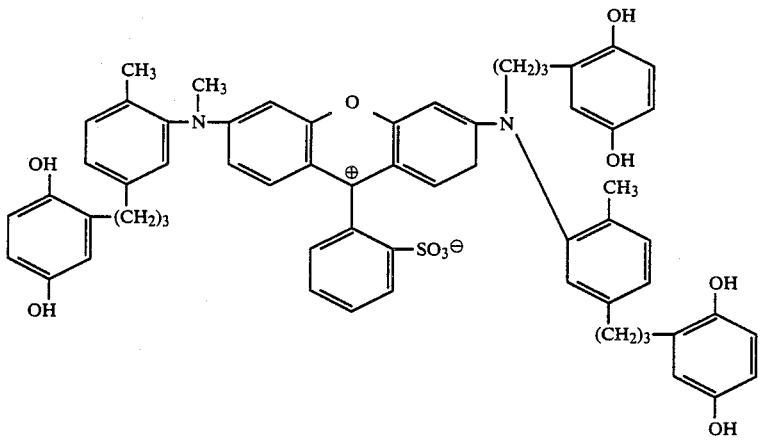

about 262 mgs/m$^2$ of gelatin; about 500 mgs/m$^2$ of 2-phenylbenzimidazole; and 55 mgs/m$^2$ of 1,3-bis[1-(4-hydroxypehnyl)-tetrazolyl-(5)-mercapto]-2-propanone oxime;

8. a layer comprising about 404 mgs/m$^2$ of Dow 620 carboxylated styrene/butadiene copolymer; and about 208 mgs/m$^2$ of gelatin;
9. a green-sensitive silver halide emulsion layer compriing about 1000 mgs/m$_2$ of silver (1.8 microns); about 471 mgs/m$^2$ of silver (1.1 microns); about 566 mgs/m$^2$ of gelatin and about 243 mgs/m$^2$ of MPHQ;
10. a layer comprising about 21131 mgs/m$^2$ of the pentapolymer described in layer 4, about 112 mgs/m$^2$ of polyacrylamide; about 607 mgs/m$^2$ of scavenger represented by the formula

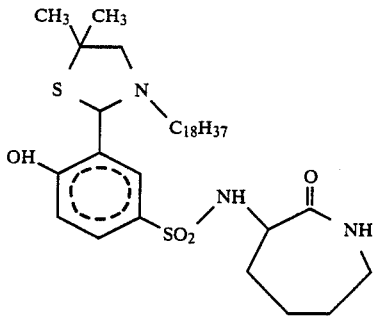

and 18 mgs/m$^2$ of succindialdehyde;

11. a layer comprising about 500 mgs/m$^2$ of benzidine yellow dye and about 150 mgs/m$^2$ of gelatin;
12. a yellow image dye-providing layer comprising about 1028 mgs/m$^2$ of a yellow image dye-providing material represented by the formula

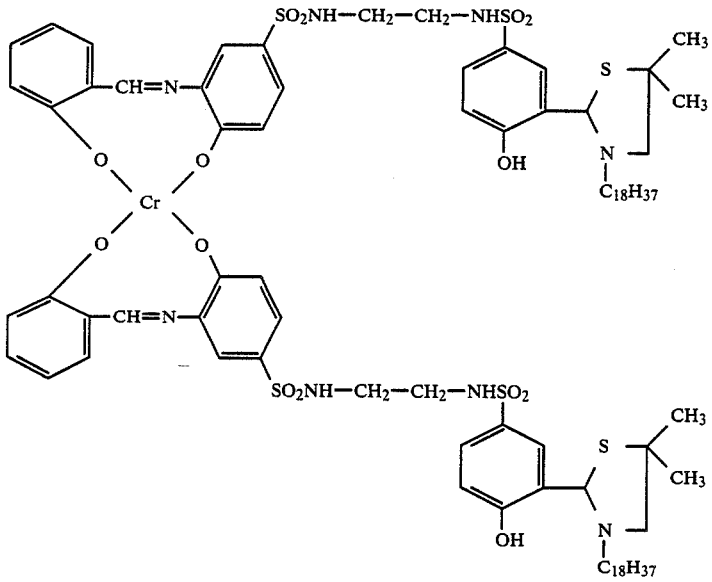

and about 431 mgs/m$^2$ gelatin;

13. a layer comprising about 514 mgs/m$^2$ of phenyl tertiary butyl hydroquinone; and about 283 mgs/m$^2$ of gelatin;
14. a blue-sensitive silver iodobromide layer comprising about 203 mgs/m$^2$ of silver (1.6 microns); about 87 mgs/m$^2$ of silver (1.3 microns); and about 145 mgs/m$^2$ of gelatin; and
15. a gelatin layer coated at a coverage of about 800 mgs/m$^2$.

A photosensitive element as aforedescribed was photoexposed (0.5 meter-candle-second) through a standardized test scale. Each of the image-receiving element of EXAMPLE 6 (IRE-5/1, -10/1, -20/1, -34/1 and -50/1) was placed into superposition with a photoexposed element. A rupturable container (retaining an aqueous alkaline processing composition, referred to as PC-7) was fixedly mounted at the leading edge of each of the elements, by pressure-sensitive tapes to make a film unit, so that, upon application of compressive force to the container to rupture the marginal seal of the container, the contents thereof would be distributed between the elements placed in a face-to-face relationship, i.e., with their respective supports outermost. The processing composition was distributed between the elements of the film unit by passing the film unit between a pair of pressure-applying rolls having a gap of approximately 0.0028 inch (0.051 mm). The processing composition PC-7) comprised the ingredients and the amounts stated as follows:

| INGREDIENTS | PARTS BY WEIGHT |
|---|---|
| Water | 40.3 |
| Titanium dioxide (rutile) | 48.0 |
| Poly(diacetone acrylamide)oxime | 0.66 |
| Potassium hydroxide (45% aqueous solution) | 4.54 |
| N—phenylpropyl-α-picolinium bromide (50% solids) | 1.44 |
| 2-methylimidazole | 0.48 |
| Hypoxanthine | 0.46 |
| Colloidal silica (30% aqueous disperson) | 0.23 |
| Opacification Dye (OD-1, described in U.S. Pat. No. 4,680,247) | 0.43 |
| Opacification Dye (OD-2, described in U.S. Pat. No. 4,680,247) | 1.49 |
| Zonyl FSN (40% solids) | 0.19 |
| Carboxylated 67/33 styrene/butadiene latex (50% solids) | 1.48 |
| 1-(4-hydroxyphenyl)-1H—tetrazole-5-thiol | 0.015 |

Each of the film units was evaluated for red, green and blue Dmin and Dmax performance, the following results being recorded:

| Film Unit From Image-Receiving Element | Dmin | | | Dmax | | |
|---|---|---|---|---|---|---|
| | R | G | B | R | G | B |
| IRE - 5/1 | 0.06 | 0.07 | 0.10 | 1.65 | 1.85 | 1.66 |
| IRE - 10/1 | 0.08 | 0.08 | 0.10 | 1.64 | 1.88 | 1.65 |
| IRE - 20/1 | 0.06 | 0.07 | 0.10 | 1.70 | 1.90 | 1.72 |
| IRE - 34/1 | 0.06 | 0.07 | 0.09 | 1.65 | 1.89 | 1.66 |
| IRE - 50/1 | 0.07 | 0.07 | 0.09 | 1.64 | 1.85 | 1.64 |

For comparative purposes, film units were prepared in the manner described in EXAMPLE 7, except that, control image-receiving elements were used in place of the image-receiving elements of the invention.

Control image-receiving element CIRE-TMQH was an image-receiving element having the same composition as each of the image-receiving elements of the invention described in EXAMPLE 6, except that, in place of layer #1, there was used as the image-receiving layer, a layer coated at a coverage of 200 mgs/ft$^2$ (2153 mgs/m$^2$) of TMQ homopolymer and 200 mg/ft$^2$ (2153 mgs/m$^2$) of polyvinyl alcohol.

Control image-receiving element CIRE-DMQH was an image-receiving element having in place of layer #1, a layer coated at a coverage of 200 mgs/ft$^2$ (2153 mgs/m$^2$) of DMQ homopolymer and 200 mgs/ft$^2$ (2153 mgs/m$^2$ of polyvinyl alcohol.

The homopolymers used in the control image-receiving elements were polymerized using the same initiator as the copolymers of the invention. The TMQ homopolymer was polymerized in water while the DMQ was polymerized in aqueous isopropanol to solubilize the water-insoluble homopolymer.

Photographic film units were prepared from photosensitive elements and the control image-receiving elements, in the manner described in EXAMPLE 7, using the same photosensitive element, processing composition, photoexposure and development. The following results were obtained:

| Film Unit From Image-Receiving Element | Dmin | | | Dmax | | |
|---|---|---|---|---|---|---|
| | R | G | B | R | G | B |
| CIRE - TMQH | 0.06 | 0.07 | 0.10 | 1.27 | 1.86 | 1.62 |
| CIRE - DMQH | 0.07 | 0.06 | 0.10 | 0.97 | 1.15 | 0.71 |

From the above data it can be seen that greater dye densities (Dmax values) were obtained from film units of the invention based on the image-receiving elements containing the copolymers of the invention (IRE−5/1, −10/1, −20/1, −34/1 and −50/1) than were obtained from film units based on the control image-receiving elements having homopolymers of either comonomer alone (CIRE-TMQH and CIRE-DMQH).

EXAMPLE 8

A 5:1 mole ratio copolymer of vinylbenzyl triethyl ammonium chloride (TEQ) and vinylbenzyl trihexyl ammonium chloride (THQ) was prepared in the following manner. Using an apparatus as described in EXAMPLE 1, 1400 mls. of water was stirred and purged with nitrogen at room temperature for 30 minutes. The nitrogen flow was interrupted and following ingredients were added in order 171 g. (0.68 mole) of TEQ; 4 g. of hexadecyl trimethyl ammonium bromide; and 58 g. (0.136 mole) of THQ. There resulted a grayish dispersion. The nitrogen purge was resumed and heating of the reaction vessel contents was started. Upon reaching 60° C., the nitrogen inlet tube was moved above the liquid surface and the initiator solution (0.85 g. of 2,2'-azobis(2-carbamidinopropane) hydrochloride in 8 mls. water) was subsequently added. The batch changed into a white latex within 30 minutes after adding the initiator. A gradual increase in viscosity was observed. The reaction mixture was stirred at 60°-61° C. for a total of five hours. On cooling, the resulting product was filtered through cheesecloth, no coagulum being observed on the cloth. The polymeric product was obtained at a solids content of 14.7% (wt/wt). Brookfield viscosity (Model LVF) determination, using spindle 2 at 12 rpm, provided a viscosity of 1200 cst.

EXAMPLE 9

Using the procedure described in EXAMPLE 8, a 9:1 mole ratio copolymer of TEQ and THQ was prepared from 23.6 g. of TEQ, 4.4 g. of THQ, 0.3 g. of hexadecyltrimethyl ammonium bromide, 180 g. of water and 0.1 g. of initiator in five mls of water. A polymeric product having a latex-like appearance and a solids content of 14.8% (wt/wt) was obtained.

EXAMPLE 10

Image-receiving elements were prepared in the manner described in EXAMPLE 6 using the copolymers prepared in each of EXAMPLES 8 and 9. Image-receiving element IRE-10A had the structure described in EXAMPLE 6, except that, in place of image-receiving layer #1, there was employed a layer comprising the 5:1 TEQ/THQ copolymer of EXAMPLE 8 at a coverage of 200 mgs/ft$^2$ (mgs/m$^2$) and PVA at a coverage of 200 mgs/ft$^2$ (mgs/m$^2$).

Image-receiving element IRE-10B had the same structure as IRE-10A, except that, in place of the 5:1 TEQ/THQ copolymer, there was employed the 9:1 TEQ/THQ copolymer of EXAMPLE 9.

EXAMPLE 11

Photographic film units were prepared in the manner described in EXAMPLE 7, using in place of the image-receiving elements thereof, the image-receiving elements of EXAMPLE 10, i.e., image-receiving elements IRE-10A and -10B. Photographic processing was performed in the manner described in EXAMPLE 7 with the following results being recorded:

| Film Unit From Image-Receiving Element | TEQ/THQ MOLE RATIO | Dmin | | | Dmax | | |
|---|---|---|---|---|---|---|---|
| | | R | G | B | R | G | B |
| IRE - 10A | 5/1 | 0.10 | 0.09 | 0.12 | 1.48 | 1.51 | 1.63 |
| IRE - 10B | 9/1 | 0.10 | 0.10 | 0.12 | 1.64 | 1.66 | 1.77 |

For purposes of comparison, a control image-receiving elements (CIRE-TEQH) was prepared in the same manner as image-receiving elements IRE-10A and -10B, except that, layer #1 comprised a TEQ homopolymer (TEQH) at a coverage of 200 mgs/ft$^2$ (2153 mgs/m$^2$) and 200 mgs/m$^2$ (2153 mg/m$^2$) of polyvinyl alcohol. A film unit was prepared and processed in the manner aforedescribed, with the following results:

| Film Unit From Image-Receiving Element | Dmin | | | Dmax | | |
|---|---|---|---|---|---|---|
| | R | G | B | R | G | B |
| CIRE - TEQH | 0.08 | 0.10 | 0.11 | 1.18 | 1.65 | 1.57 |

Inspection of the above data shows that greater levels of maximum dye density (particularly red density) were obtained from film units based on image-receiving elements IRE-10A and -10B containing copolymer mordants of the invention compared with the film unit based on image-receiving element (CIRE-TEHQ) containing the TEQ homopolymer.

What is claimed is:

1. An image-receiving element which comprises a support carrying an image-receiving layer comprising a copolymeric mordant having recurring units according to the formula

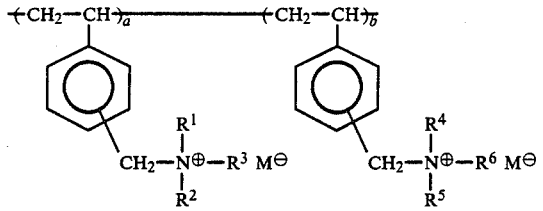

wherein each of $R^1$, $R^2$ and $R^3$ is independently alkyl of from 1 to 4 carbon atoms; each of $R^4$, $R^5$ and $R^6$ is independently alkyl of from 1 to 18 carbon atoms and the total number of carbon atoms in $R^4$, $R^5$ and $R^6$ is from 13 to 20; each $M^{\ominus}$ is an anion; and each of a and b is the molar proportion of each of the respective repeating units.

2. The image-receiving element of claim 1 wherein the molar ratio of a:b is in the range of from 2:1 to 50:1.

3. The image-receiving element of claim 2 wherein the total number of carbon atoms in $R^1$, $R^2$ and $R^3$ is from 3 to 9.

4. The image-receiving element of claim 3 wherein each of $R^1$, $R^2$ and $R^3$ is methyl.

5. The image-receiving element of claim 3 wherein each of $R^1$, $R^2$ and $R^3$ is ethyl.

6. The image-receiving element of claim 2 wherein $R^4$ has from 11 to 18 carbon atoms and wherein the total number of carbon atoms in $R^4$, $R^5$ and $R^6$ is from 13 to 20.

7. The image-receiving element of claim 6 wherein $R^4$ is n-dodecyl and each of $R^5$ and $R^6$ is methyl.

8. The image-receiving element of claim 2 wherein each of $R^1$, $R^2$ and $R^3$ is methyl and each of $R^4$, $R^5$ and $R^6$ is n-hexyl.

9. 1 The image-receiving element of claim 2 wherein $R^4$ is n-dodecyl and each of $R^1$, $R^2$, $R^3$, $R^5$ and $R^6$ is methyl.

10. The image-receiving element of claim 1 wherein said image-receiving layer comprises a mixture of said copolymeric mordant and a hydrophilic polymer.

11. The image-receiving element of claim 10 wherein said hydrophilic polymer comprises polyvinyl alcohol.

12. The image-receiving element of claim 11 wherein the ratio by weight of said polyvinyl alcohol to said copolymeric mordant is about 0.3:1 to about 3:1.

13. The image-receiving element of claim 1 wherein between said image-receiving layer and said support there is present a polymeric acid-reacting layer and a polymeric timing layer through which alkali may diffuse to said polymeric acid-reacting layer, said polymeric acid-reacting layer being contiguous to said support.

14. The image-receiving element of claim 13 wherein said support comprises an opaque paper support.

15. A diffusion transfer film unit which comprises a photosensitive system comprising at least one photosensitive silver halide emulsion layer having associated therewith a diffusion transfer process image dye-providing material and an image-receiving layer adapted to receive an image dye-providing material after photoexposure and processing, said image-receiving layer comprising a copolymeric mordant having recurring units according to the formula

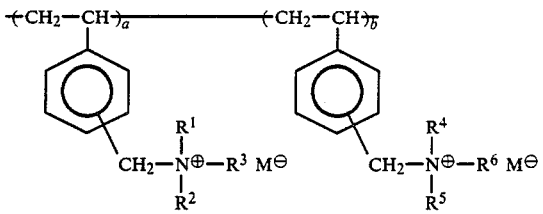

wherein each of $R^1$, $R^2$ and $R^3$ is independently alkyl of from 1 to 4 carbon atoms; each of $R^4$, $R^5$ and $R^6$ is independently alkyl of from 1 to 18 carbon atoms and the total number of carbon atoms in $R^4$, $R^5$ and $R^6$ is from 13 to 20; each $M^{\ominus}$ is an anion; and each of a and b is the molar proportion of each of the respective repeating units.

16. The diffusion transfer film unit of claim 15 wherein said unit is an integral negative-positive film unit which comprises:

a photosensitive element comprising a composite structure containing, as essential layers, in sequence, an opaque layer, said photosensitive system, said image-receiving layer, and a transport layer; and means retaining an aqueous alkaline processing composition integrated with said film unit so that said processing composition can be distributed between said photosensitive system and said image-receiving layer, said processing composition providing a light-reflecting pigment such that the distribution of said processing composition between said photosensitive system and said image-receiving layer provides a light-reflecting layer against which a dye image formed in said image-receiving layer can be viewed.

17. The diffusion transfer film unit of claim 15 wherein said unit is an integral negative-positive film unit which comprises:

a photosensitive element comprising, as essential layers, in sequence, a transparent layer, said image-receiving layer, a processing composition permeable light reflecting layer against which a dye image formed in said image-receiving layer can be viewed, and said photosensitive system;

a transparent sheet superposed substantially coextensive the surface of said photosensitive element opposite said transparent layer; and means retaining an aqueous alkaline processing composition, which includes an opacifying agent, integrated with said film unit such as said processing composition can be distributed between said photosensitive system and said transparent sheet.

18. The diffusion transfer film unit of claim 15 wherein said 15 wherein the molar ratio of a:b in said mordant copolymer is in the range of from 2:1 to 50:1.

19. The diffusion transfer film unit of claim 18 wherein said image-receiving layer comprises a mixture of said copolymeric mordant and a hydrophilic polymer.

20. The diffusion transfer film unit of claim 19 wherein said hydrophilic polymer comprises polyvinyl alcohol.

21. The diffusion transfer film unit of claim 18 wherein $R^4$ is n-dodecyl, each of $R^1$, $R^2$, $R^3$, $R^5$ and $R^6$ is methyl and each $M^{\ominus}$ is chloride.

22. The diffusion transfer film unit of claim 21 wherein the mole ratio of a:b is from 10:1 to 20:1.

23. The diffusion transfer film unit of claim 18 wherein each of $R^1$, $R^2$, $R^3$, is methyl, each of $R^4$, $R^5$ and $R^6$ is n-hexyl and each $M^{\ominus}$ is chloride.

24. The diffusion transfer film unit of claim 23 wherein the mole ratio of a:b is from 5:1 to 10:1.

* * * * *